US006648721B2

(12) United States Patent
Rehkemper et al.

(10) Patent No.: US 6,648,721 B2
(45) Date of Patent: Nov. 18, 2003

(54) DOLL AND TUBULAR CLOTHING

(75) Inventors: Steven Rehkemper, Chicago, IL (US); Kerry E. Phillips, South Holland, IL (US); Dennis O'Patka, Chicago, IL (US)

(73) Assignee: Rehco, LLC, Chicago, IL (US)

( * ) Notice: Subject to any disclaimer, the term of this patent is extended or adjusted under 35 U.S.C. 154(b) by 0 days.

(21) Appl. No.: 09/853,857

(22) Filed: May 11, 2001

(65) Prior Publication Data

US 2002/0168917 A1 Nov. 14, 2002

(51) Int. Cl.[7] ..... A63H 3/36

(52) U.S. Cl. ..... 446/390; 446/98; 446/474; 446/268

(58) Field of Search ..... 446/268, 387, 446/226, 390, 26, 28, 98, 320, 474, 385; 434/395, 396

(56) References Cited

U.S. PATENT DOCUMENTS 2,944,368 A * 7/1960 O'Brain ..... 446/100
3,628,282 A * 12/1971 Johnson et al. ..... 446/375
3,668,805 A * 6/1972 Coleman ..... 446/98
3,862,513 A * 1/1975 Isaacson et al. ..... 273/108.22
3,988,855 A * 11/1976 Crabtree et al. ..... 446/380
4,297,153 A * 10/1981 Erickson et al. ..... 156/297
4,414,774 A * 11/1983 Fogarty et al. ..... 446/98
5,328,400 A * 7/1994 Bass ..... 428/100
5,746,639 A * 5/1998 Bloom et al. ..... 446/369
6,227,930 B1 * 5/2001 Norman et al. ..... 2/243.1
6,273,780 B1 * 8/2001 Gardner ..... 426/104

* cited by examiner

*Primary Examiner*—Derris H. Banks
*Assistant Examiner*—Bena B. Miller

(57) ABSTRACT

A generally tubular doll body having hinged upper and lower leg portions. The doll body is provided with arms sockets for freely rotatable arms and a stem for receiving a head. The doll can be accessorized with tubular dresses, skirts, bracelets etc. The doll further includes a head portion on which various hair designs can be placed.

7 Claims, 2 Drawing Sheets

DOLL AND TUBULAR CLOTHING

BACKGROUND OF THE INVENTION

Dolls have long been the mainstay as a toy for young children all the way from infants to teens. There have been numerous varieties of dolls from the ever-popular Barbie to the current very popular American Girl dolls.

SUMMARY OF THE INVENTION

There is herein described and illustrated a very unique doll that is generally tubular in shape that can readily receive a wide variety of tubular clothing and accessories. The clothing, and accessories generally made of stretch fabric that can slide up and over the body and arms without difficulty. The clothing and accessories can be located on the doll very easily and thus does not require a great deal of dexterity. Very small children will find it easy to dress and undress the doll as well as add a variety of accessories. The generally tubular shape of the dolls readily accepts tubular shirts, skirts, dresses, bathing suits, undergarments etc. The tubular outfits can be made in a variety of soft stretchable moldable materials that can be readily slid over the body and located wherever desired. The elasticity and stretchability of the material will retain the outfit in place once it has been placed where desired. Accessories that can be readily attached are bracelets, watches and hair accessories. The doll is constructed of a moldable plastic and while the torso and legs are generally tubular in shape to conform to the general outline of a doll the legs while fixed together can be bent and shaped at the hips and knees to place the doll in any number of positions in which they will remain.

The generally tubular configuration of the torso includes an upwardly extending stem portion for receiving a head. The torso also includes connections for the arms whereby the arms can be moved to various positions relative to the doll torso. The doll assembly may also include a base into which feet can be inserted to retain the doll in an upright position. The doll while generally tubular includes an arched back to give the doll a very life like look.

The clean lines of the doll make handling, adjusting, accessorizing, dressing and undressing very easy for a young child.

Other features and advantages of the novel doll will be apparent from the following description and drawings in which.

DESCRIPTION OF THE INVENTION

Figure 1:
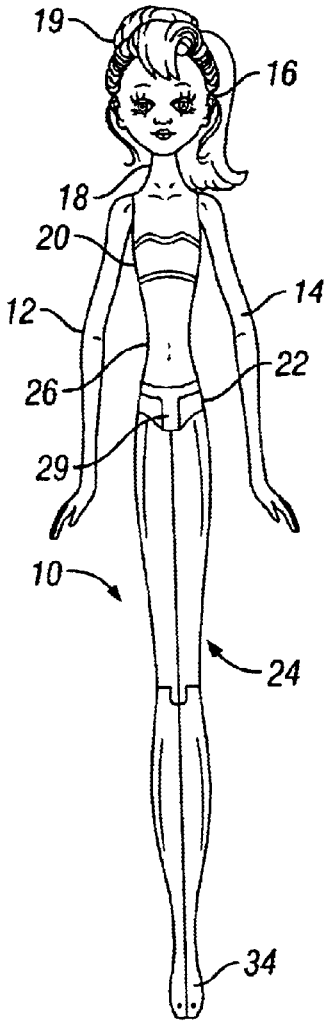
FIG. 1 is a front view of the doll.

Referring first to FIG. 1 there is illustrated a generally tubular doll 10 standing in a slightly arched position and the arms 12, 14 shown in a downwardly extending position. A head 16 is positioned on an upwardly extending tubular stem 18. The doll 10 is shown dressed with a top 20 and shorts 22. The head 16 is provided with a hairpiece 19, that is interchangeable with other hair pieces having different styles.

The upper portion of the legs 24 and the bottom of the torso are hinged together by a pin extending through the upper parts of the legs and a downwardly extending torso portion 29. The knees 30 are hinged via a pin 32 extending through the interconnected leg portions. The arms 12, 14 are fitted into sockets whereby they can be freely rotated to different positions. While in the embodiment illustrated there are illustrated hinged connections between the torso 26 and upper leg portions and at the knees 30 the doll torso and legs can be formed in one generally tubular configuration without hinged connections.

Figure 2:
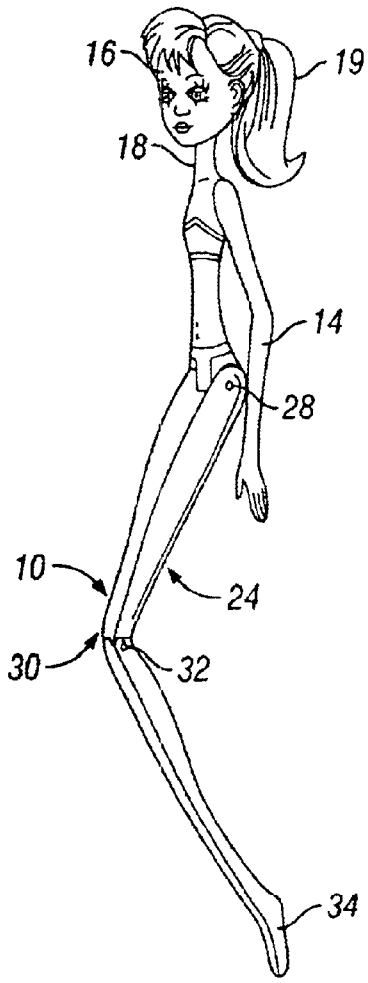
FIG. 2 is a side view with the hips and knees hinged out of alignment with each other and with the doll torso.

In FIG. 2 the upper and lower leg portions are shown in the hinged positions and this figure illustrates the slight arching of the back. The arms 12, 14 could also be hinged at the elbows if desired.

Figure 3:
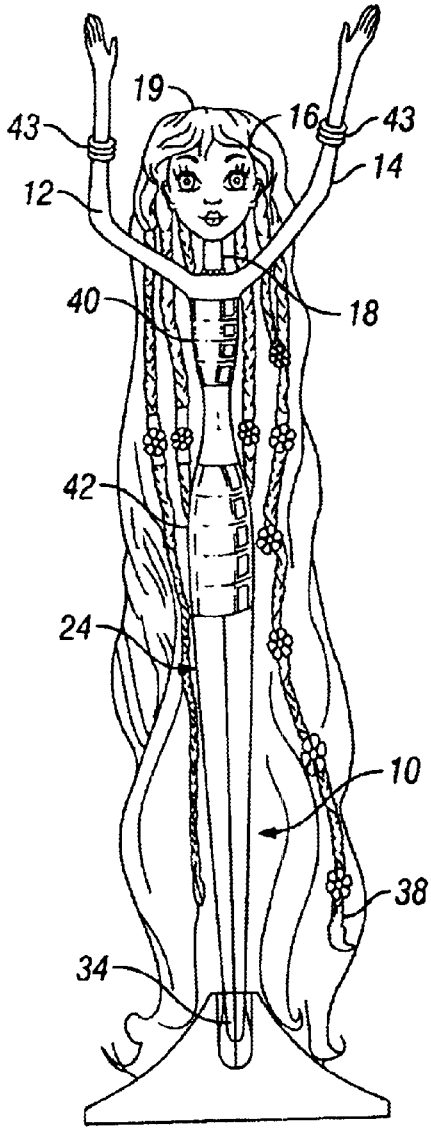
FIG. 3 illustrates a doll mounted on a stand and accessorized with hair and a tubular bracelet, top and skirt.
Figure 4:
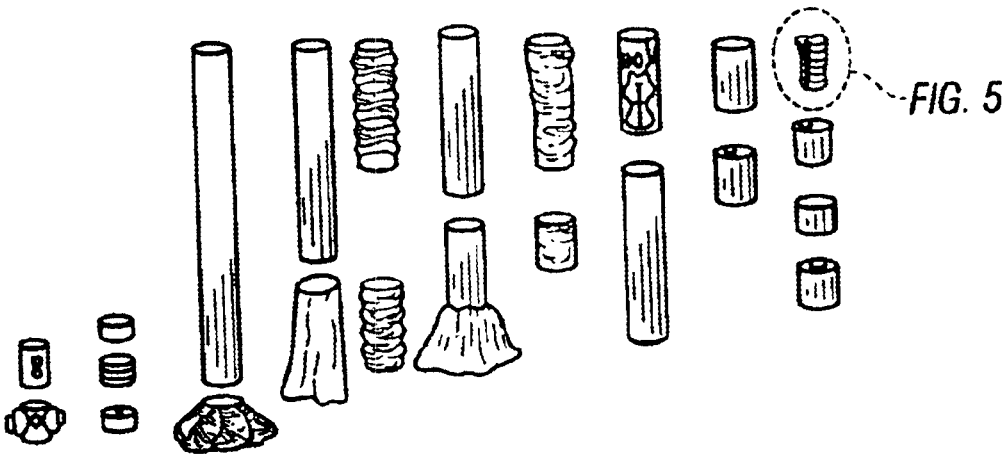
FIG. 4 illustrates a number of tubular outfits and accessories for the doll.

FIG. 3 shows the generally tubular doll 10 with its feet 34 disposed in a base 36 and the arms 12, 14 outstretched. This doll version has long hair 38 and is dressed with a tubular top 40, a tubular skirt 42 and accessorized with tubular bracelets 43. In FIG. 4 there are illustrated in tubular shaped items such as dresses, skirts, evening gowns, bathing suits etc. as well as accessories such as watches, bracelets etc. Those items shown in FIG. 4 are but a few of those that can be applied to the basic generally tubular doll.

Figure 5:
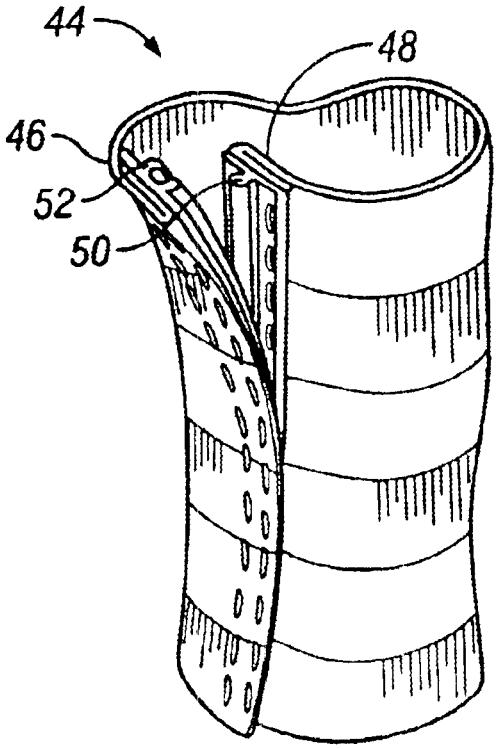
FIG. 5 illustrates a particular construction of a doll skirt.

In FIG. 5 there is illustrated the construction of a tubular skirt 44 that essentially consists of a square piece of material that is formed into a tubular skirt by forming the interconnecting end portions 46, 48 with transversely extending interconnecting, interlocking tongue 50 and grove 52 sections.

It is, of course, intended to cover the appended claims all such modifications and embodiments that fall within the true spirit and scope of the invention.

What is claimed is:

1. A doll comprising:

a torso having a lower end and an upper end with an upstanding stem portion extending from said upper end, the torso having a cylindrical cross section that tapers towards an area disposed intermediate of the upper and lower ends of the torso;

a head mounted on said stem portion;

arms connected to the upper end of said torso;

leg portions connected to the lower end of said torso by a hinge wherein the leg portions are pivotally attached to said lower end of said torso, the leg portions further defined as having an upper leg section pivotally attached to a lower leg section at a knee area, the lowering leg section, and the upper leg section are separately molded as integral unitary leg sections, each of the unitary leg section includes a definition down a center of the leg unit to create an appearance of partitioned legs, the upper leg section and lower leg section are further defined as having a cylindrical cross section that tapers towards the knee area;

unitary integral feet portions extending from said lower leg section; and clothing having a single tubular construction, the tubular construction being made out of a stretchable elastic fabric such that when the article of clothing is slid over the tapered cylindrical cross sections of the lower leg section, the upper leg section and the torso to an area defined thereon, the clothing remains affixed to said area, wherein the clothing having said single tubular construction and said doll having unitary leg sections and a tapered cylindrical cross sections allows a user with limited dexterity to slide the clothing onto the doll.

2. A doll as set forth in claim 1 including a base for receiving the feet portions, the base supports the doll in a generally upright position.

3. A doll as set forth in claim 2 in which the doll torso, legs and arms are made of a moldable relatively soft plastic whereby the arms and legs can be moved in and out of various positions without difficulty.

4. A doll comprising:

a torso having a lower end and an upper end with an upstanding stem portion extending from said upper end, the torso having a cylindrical cross section that tapers towards an area disposed between the upper and lower ends of the torso;

a head mounted on said stem portion;

arms connected to the upper end of said torso;

legs connected to the lower end of said torso by a hinge wherein the legs are pivotally attached to said lower end of said torso, the legs further defined as having an upper leg section pivotally attached to a lower leg section at a knee area, the upper leg section and lower leg section having a cylindrical cross section that tapers towards the knee area, the upper leg section is formed as an integral unitary unit with a definition positioned down the center of the upper leg section to create an appearance of partitioned upper legs and the lower leg section is formed as an integral unitary unit with a definition positioned down a center of the lower leg section to create an appearance of partitioned lower legs;

feet portions extending from said lower leg section, the feet portions being an integral unitary unit with a definition positioned down a center thereof such that the feet portions create an appearance of partitioned feet; and clothing having a single internal tubular construction, the tubular construction being made out of a stretchable elastic fabric such that when the article of clothing is slid over the tapered cylindrical cross sections of the lower leg section, the upper leg section and the torso to an area defined thereon, the clothing remains affixed to said area, wherein the clothing having said internal tubular construction and said doll having tapered cylindrical cross sections allows a user with limited dexterity to slide the clothing onto the doll.

5. A doll and clothing in combination therewith, comprising:

a doll having a torso defining a lower end and an upper end with an upstanding stem portion extending from said upper end, a head mounted on said stem portion, a pair of arms connected to the upper end of said torso, and a single unitary leg portion extending from the lower end of said torso and having a end portion further extending therefrom, the single unitary leg portion having a definition positioned in a center thereof to provide an appearance of partitioned legs and the end portion having a definition positioned thereon to provide an appearance of partitioned feet; and stretchable fabric clothing having a single and substantially internal tubular construction that when applied to a portion of the doll, the stretchable tubular clothing remains affixed to said portion, wherein the clothing having said substantially internal tubular construction allows a user with limited dexterity to slide the clothing onto the doll.

6. The combination in claim 5, wherein the doll has a generally tapered cylindrical cross section that slightly increases in diameter from the feet to the head.

7. The combination in claim 6, wherein the leg portion consists of upper and lower leg portions that are hinged together by a hinge.

* * * * *